US008827626B2

(12) United States Patent
Seljestad

(10) Patent No.: US 8,827,626 B2
(45) Date of Patent: Sep. 9, 2014

(54) EXCAVATOR THUMB ASSEMBLY

(75) Inventor: Gregory A. Seljestad, Wamego, KS (US)

(73) Assignee: Caterpillar Inc., Peoria, IL (US)

( * ) Notice: Subject to any disclaimer, the term of this patent is extended or adjusted under 35 U.S.C. 154(b) by 356 days.

(21) Appl. No.: 13/298,648

(22) Filed: Nov. 17, 2011

(65) Prior Publication Data

US 2012/0163950 A1 Jun. 28, 2012

Related U.S. Application Data

(60) Provisional application No. 61/426,153, filed on Dec. 22, 2010.

(51) Int. Cl.

| | |
|---|---|
| ***B66F 9/00*** | (2006.01) |
| ***E02F 3/413*** | (2006.01) |
| ***E02F 3/96*** | (2006.01) |
| ***E02F 3/40*** | (2006.01) |

(52) U.S. Cl.

CPC ..... *E02F 3/404* (2013.01); *E02F 3/4135* (2013.01); *E02F 3/962* (2013.01)

USPC ..... 414/724; 414/722; 37/403; 37/406

(58) Field of Classification Search

CPC ..... E02F 3/00; E02F 3/30; E02F 3/36; E02F 3/40; E02F 3/58; E02F 3/60; E02F 3/96; E02F 3/404; E02F 3/413; E02F 3/435; E02F 3/962; E02F 3/963; E02F 3/3622; E02F 3/3627; E02F 3/4135; E02F 3/8152; E02F 3/8825; E02F 9/26; E02F 9/2025; E02F 9/2235; E02F 9/2292; E02F 9/2296

USPC ..... 29/426.2; 37/306, 348, 403, 406, 410, 37/443, 466, 468, 903; 91/443, 461, 463; 222/383.1; 414/691, 722–724, 729, 414/732–740, 815; 701/50; 13/232, 951

See application file for complete search history.

(56) References Cited

U.S. PATENT DOCUMENTS

| | | | | |
|---|---|---|---|---|
| 649,244 | A | 5/1900 | Hetlesaeter | |
| 4,890,607 | A * | 1/1990 | Townsend | 602/26 |
| 6,203,267 | B1 | 3/2001 | Heiple et al. | |
| 6,450,081 | B1 * | 9/2002 | Sorbel | 91/443 |
| 7,818,901 | B2 | 10/2010 | Zeno et al. | |
| 2003/0167662 | A1 * | 9/2003 | Desrochers | 37/406 |

* cited by examiner

*Primary Examiner* — Gregory Adams
*Assistant Examiner* — Ronald Jarrett

(57) ABSTRACT

A thumb assembly mountable to a stick of an excavator is provided. The thumb assembly comprises a base member having at least a first joint location, a thumb member pivotally connected to the base member, and first and second linkage members pivotally connected at their first ends to the thumb member and the joint location respectively. The linkage members are connected by a knee joint at their second ends such that they are foldable relative to each other between a working position and a storage position in which the thumb member extends close to the base member. The knee joint permits both relative rotation and relative sliding of the first and second linkage members so that the thumb assembly can be moved between the working position and the storage position without disconnecting the linkage members from the thumb member and the joint location on the base member.

11 Claims, 8 Drawing Sheets

EXCAVATOR THUMB ASSEMBLY

RELATED APPLICATIONS

This application is based upon claims the benefit of priority from U.S. Provisional Application No. 61/426,153 by Gregory A. Seljestad, filed Dec. 22, 2010, the contents of which are expressly incorporated herein by reference.

TECHNICAL FIELD

The present disclosure relates to an excavator thumb assembly. More particularly, the present disclosure relates to an excavator thumb assembly of the type mounted on an excavator stick in which a thumb member is pivotally mounted to oppose an excavator bucket.

BACKGROUND

An excavator thumb member is an implement which is typically pivotally mounted on the underside of a stick of an excavator and which opposes and cooperates with the excavator bucket for grasping material held between the bucket and the thumb. Typically in use, the thumb member is fixed relative to the stick and extends away from the stick. The bucket is curled and uncurled relative to the stick to grasp and hold the material to be handled. Prior art thumb members may be connected to the stick with a strut whose position can be adjusted to permit adjustment of the angle of the thumb member relative to the stick. The strut may consist of a rigid link detachably securable by pins to one of a number of brackets or attachment points provided on the stick. Typically the thumb member can be pivoted to a storage position in which the thumb member extends along the stick. However moving the thumb member to the storage position requires an operator to unpin the link and to use a lifting device to lift the thumb member and the link to a storage position in which it can be pinned to lock it to the stick.

The present invention is directed to overcoming one or more of the problems as set forth above.

SUMMARY OF THE INVENTION

In one aspect, the present disclosure is directed to a thumb assembly mountable to a stick of an excavator, the thumb assembly comprising: a base member having at least a first joint location, a thumb member pivotally connected to the base member, a first linkage member having first and second ends and being pivotally connected at the first end to the thumb member, a second linkage member having first and second ends and being pivotally connectable at the first end to the joint location, wherein the first and second linkage members are connected by a knee joint at their second ends such that they are foldable relative to each other between a working position in which the thumb member extends away from the base member and a storage position in which the thumb member extends close to the base member, wherein the knee joint permits both relative rotation and relative sliding of the first and second linkage members.

In another aspect, the present disclosure is directed to a method of moving a thumb member of a thumb assembly mounted to a stick of an excavator from a storage position to a working position, the thumb assembly further comprising a base member having first and second joint locations, a first linkage member having first and second ends and being pivotally connected at the first end to the thumb member, and a second linkage member having first and second ends and being selectively pivotally connectable at the first end to the first and second joint locations, wherein the thumb member is pivotally connected to the base member and wherein the first and second linkage members are connected by a knee joint at their second ends, the method comprising the steps of:

connecting the first end of the second linkage member to the first joint location while the thumb member is locked in the storage position;

unlocking the thumb member from the base member;

moving the thumb member to a first working position while permitting both relative rotation and relative sliding of the first and second linkage members; and locking the first and second linkage members against relative rotation in the first working position.

At least one of the above embodiments provides one or more solutions to the problems and disadvantages with the background art. Other technical advantages of the present disclosure will be readily apparent to one skilled in the art from the following description and claims. Various embodiments of the present application obtain only a subset of the advantages set forth. No one advantage is critical to the embodiments. Any claimed embodiment may be technically combined with any other claimed embodiment(s).

BRIEF DESCRIPTION OF THE DRAWINGS

The accompanying drawings illustrate presently preferred exemplary embodiments of the disclosure, and together with the general description given above and the detailed description of the preferred embodiments given below, serve to explain, by way of example, the principles of the disclosure.

DETAILED DESCRIPTION

Figure 1:
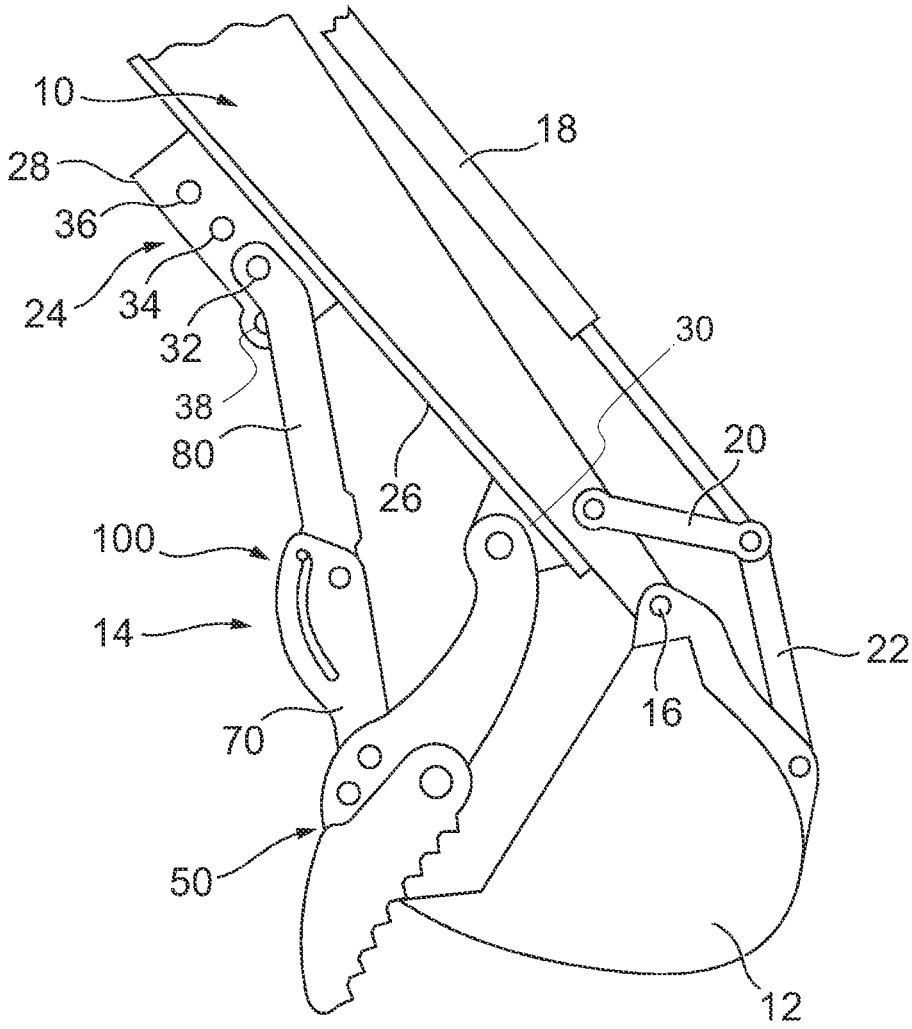
FIG. 1 is a diagrammatic illustration of an excavator stick provided with a thumb assembly according to an exemplary embodiment of the present disclosure.

Referring to FIG. 1, there is shown a stick 10 of an excavator (not shown) which carries a bucket 12 and a thumb assembly 14. The stick 10 or operating arm is typically hydraulically operated by an operator to move the bucket 12 to a location where the bucket can be curled about its axis of rotation 16 to scoop up material, and then to move the bucket 12 to a further location where the bucket can be uncurled about its axis of rotation 16 and the material emptied from the bucket. The curling and uncurling of the bucket 12 may be controlled by a hydraulic ram 18 connected to the stick 10 and a series of linkage members 20, 22 which are pivotally connected to the stick 10 and bucket 12. The control of the bucket 12 does not form part of the present disclosure.

Figure 2:
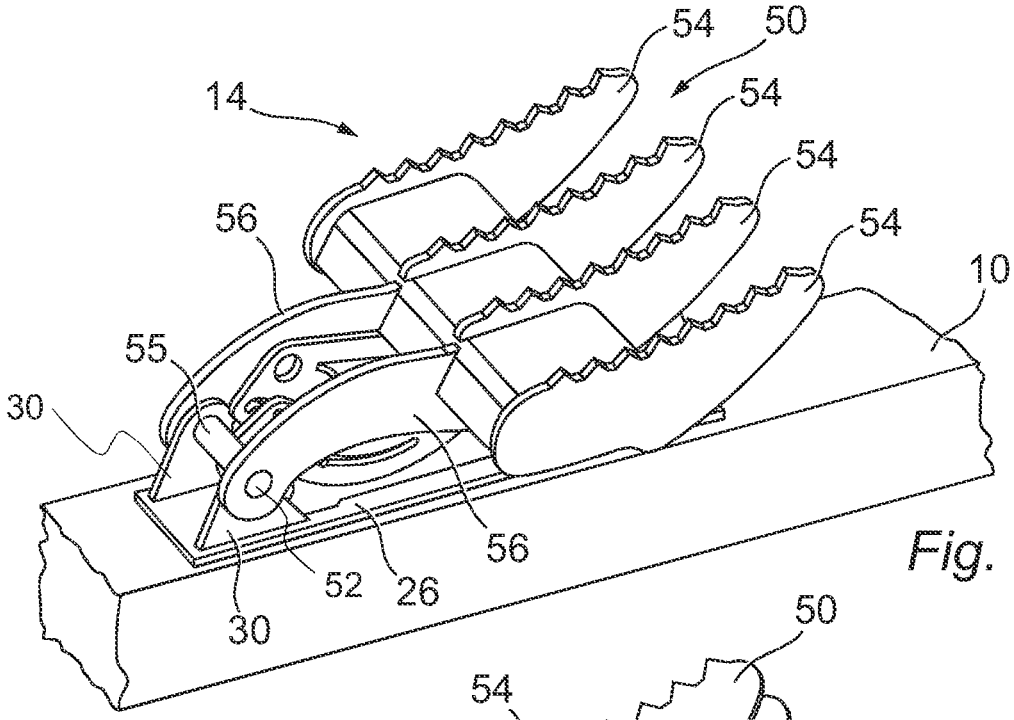
FIG. 2 is a diagrammatic illustration of a thumb assembly according to an exemplary embodiment of the present disclosure in a storage position.
Figure 3:
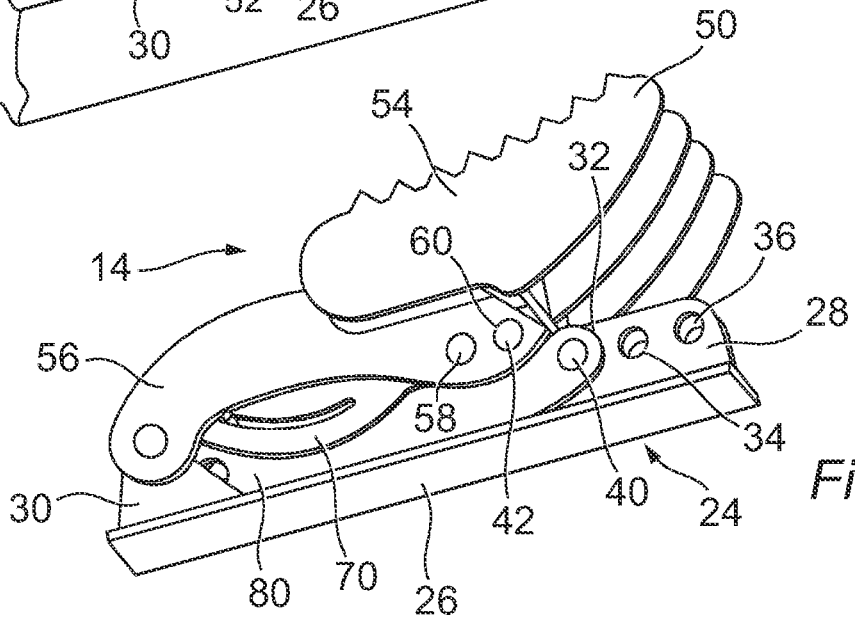
FIGS. 3 to 8 show sequentially the steps of unfolding the thumb assembly of FIG. 2 from a storage position in FIG. 3 to a first working position in FIG. 8.
Figure 6:
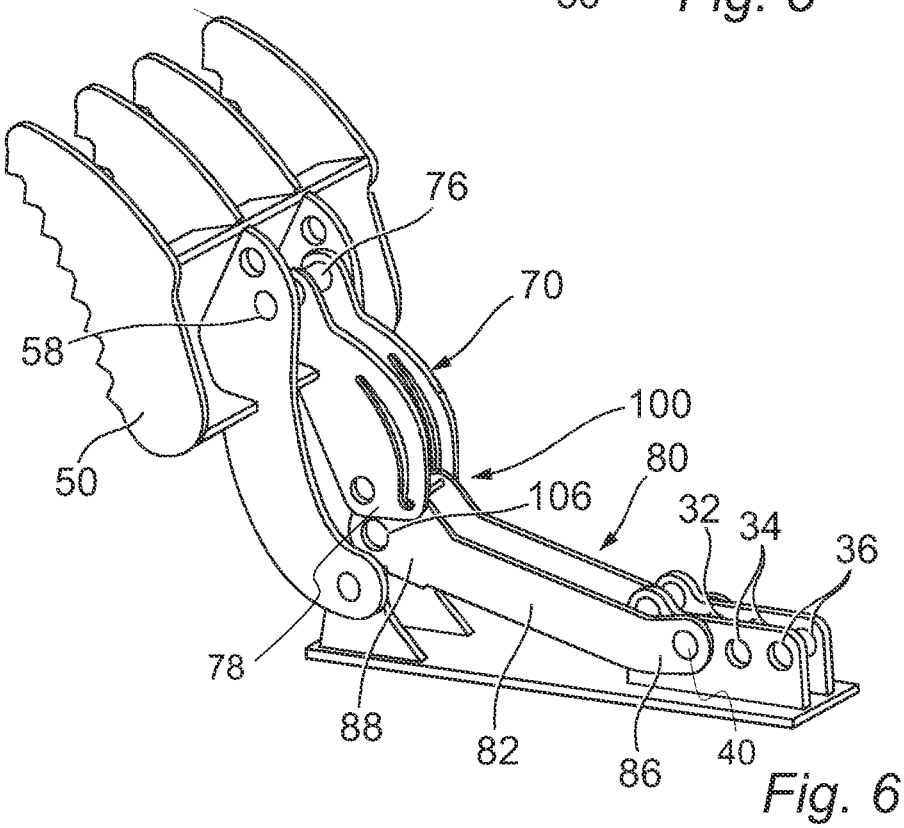
Figure 7:
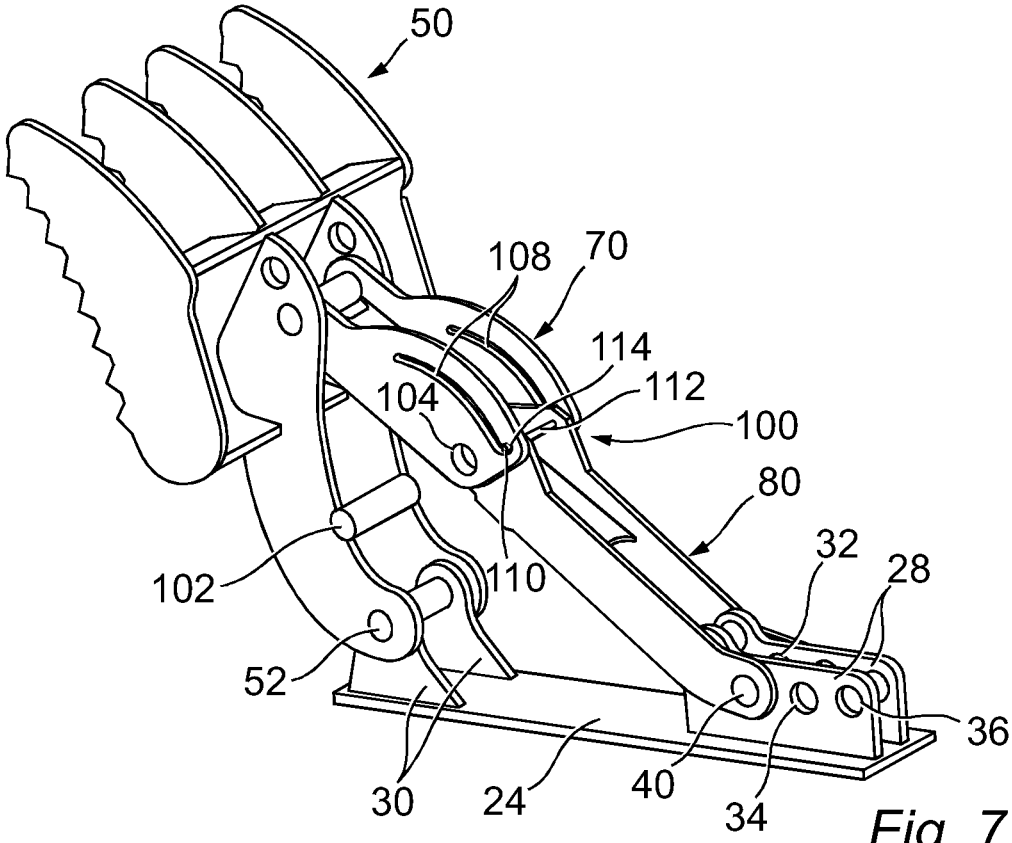
Figure 8:
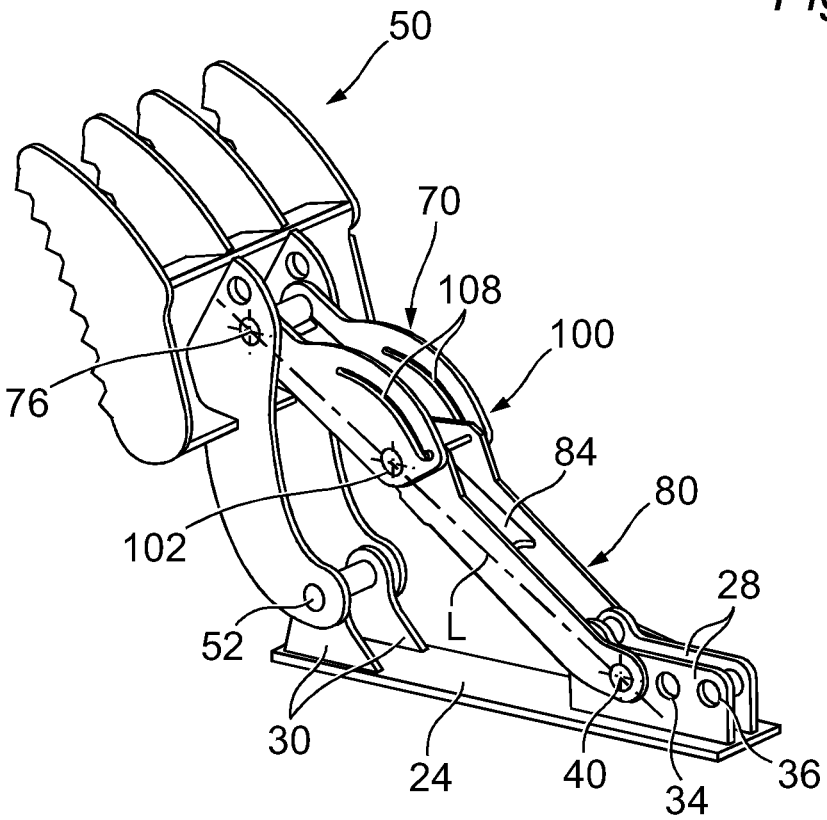

The thumb assembly of FIGS. 1 and 2 is shown in FIGS. 3 to 8 moving from a storage position in FIG. 3 through the intermediate positions of FIGS. 4 to 7 to the working position of FIG. 8. The thumb assembly 14 includes a base member 24 which may be fixed to the stick 10 in any appropriate way. In the illustrated example the base member 24 includes a base plate 26 which is attached to the underside of the stick 10 by welding. Mounted on the base plate 26 are two spaced apart linkage member mounting plates 28 and two spaced apart thumb mounting lugs 30. Each linkage member mounting plate 28 is provided with one or more pivot joint locations 32, 34, 36 and a locking pin location 38. In the illustrated example there are three pivot joint locations 32, 34, 36, which are formed as apertures through which a removable pivot pin 40 can be fixed, each of which corresponds to a different working position of the thumb assembly. However more or fewer pivot joint locations can be provided. In the illustrated example, the locking pin location 38 is formed as a circular aperture through which a locking member such as a removable locking pin 42 can be fixed. However any suitable shape of aperture and locking member 42 may be used.

The pivot joint locations 32, 34, 36 may take different forms other than the simple aperture illustrated, as will be understood by those skilled in the art. For example each pivot joint location 32, 34, 36 may comprise means for receiving one or more fasteners which hold a mount (not shown) for a bearing or pin, so that a linkage member can be pivotally secured to the base member 24. The base member 24 may be secured to the stick 10 by bolts or other fasteners. The linkage member mounting plates 28 and thumb mounting lugs 30 of the base member 24 may be secured directly to the stick 10 without the base plate 26. The thumb mounting lugs 30 may be replaced by any other suitable pivot mounting means. If required the thumb can be arranged to pivot on the pivot axis 16 of the bucket 12.

A thumb member 50 is pivotally connected to the base member 24 by means of a thumb mounting pin 52 and the thumb mounting lugs 30. In the illustrated example, the thumb member 50 is shown with four blade members 54, but the thumb member 50 may have any number of blades of any shape and configuration. The thumb member 50 has two web members 56 which connect the blade members 54 to the thumb mounting pin 52. Each web member 56 is provided with a pivot joint location 58 and a locking pin location 60 behind the blade members 54.

A first linkage member 70 comprises two webs 72 which may be connected by one or more spacers or intermediate webs (not shown). The first linkage member 70 has a first end 74 which is pivotally connected by a pivot pin 76 to the pivot joint location 58 of the thumb member 50, and a second end 78 which is pivotally connectable to a second linkage member 80.

The second linkage member 80 comprises two webs 82 which are connected by an intermediate web 84. The second linkage member 80 has a first end 86 which may be pivotally connected by the removable pivot pin 40 to any of the pivot joint locations 32, 34, 36 on the base member 24. The second end 88 is pivotally connectable to the first linkage member 70.

The connection between the first linkage member 70 and the second linkage member 80 is a knee joint 100. The knee joint 100 includes a locking member such as a removable locking pin 102 which, when in position, engages with a locking pin aperture 104 at the second end 78 of the first linkage member 70 and with a locking pin aperture 106 at the second end 88 of the second linkage member 80. In the illustrated example the locking pin apertures 104, 106 are formed as circular apertures. However any suitable shape of aperture 104, 106 and locking member 102 may be used.

The knee joint 100 also includes a guide path 108 in each of the webs 72 of the first linkage member 70. In the illustrated example the guide path 108 is formed as a through slot, although any other suitable guide path 108 may be used, for example a channel or cam surface. The guide path 108 is shown as a curved path with a centre of curvature on the inside of the knee joint. However the guide path 108 may be straight or of an opposite or varying curvature. Each guide path 108 is engaged by a guide engaging tool 110 fixed to the second end 88 of the second linkage member 80. In the illustrated example the guide engaging tool 110 is a guide pin provided on the end of a rod 112 fixed to the webs 82 of the second linkage member 80. Each end of the rod 112 forms a separate guide pin 110. Any other suitable guide engaging tool may be used, for example a roller or cam follower. However it will be apparent to those skilled in the art that the arrangement of guide path 108 and guide engaging tool 110 can be reversed so that the guide path 108 is formed on the second linkage member 80 and the guide engaging tool 110 is formed on the first linkage member 70. Thus when the removable pivot pin 102 is removed, the knee joint 100 permits relative sliding of the first and second linkage members, restrained by the movement of the guide pin 110 in the slot 108, as well as relative rotation about the axis of the guide pin 110.

The slot 108 includes a return portion 114 at its end, adapted to engage the guide pin 110 when the knee joint is fully unfolded as shown in FIGS. 7 and 8. When the guide pin 110 is engaged in the return portion 114, the pivot pin aperture 104 of the first linkage member 70 is aligned with the pivot pin aperture 106 of the second linkage member 80, and the removable pivot pin 102 can be located in the pivot pin apertures 104, 106. When the removable pivot pin 102 is so located the knee joint is effectively locked because the return portion 114 of the slot 108 bears on the guide pin 110 to prevent relative rotation of the first linkage member 70 and second linkage member 80 about the axis of the removable pivot pin 102.

INDUSTRIAL APPLICABILITY

Referring to FIG. 3, the thumb assembly 14 is shown in its storage position. The locking pin 42 is engaged in both the locking pin location 38 on the base member 24 and the locking pin location 60 on the thumb member 50 so that the thumb member 50 is restrained from rotation about the thumb member pin 52. When an operator wishes to move the thumb assembly 14 to a working position, he first selects the appropriate pivot joint location 32, 34, 36 to which to connect the second pivot member 80. In FIG. 3 the removable pivot pin 40 has been placed in the lower 32 of the three pivot joint locations 32, 34, 36.

Figure 4:
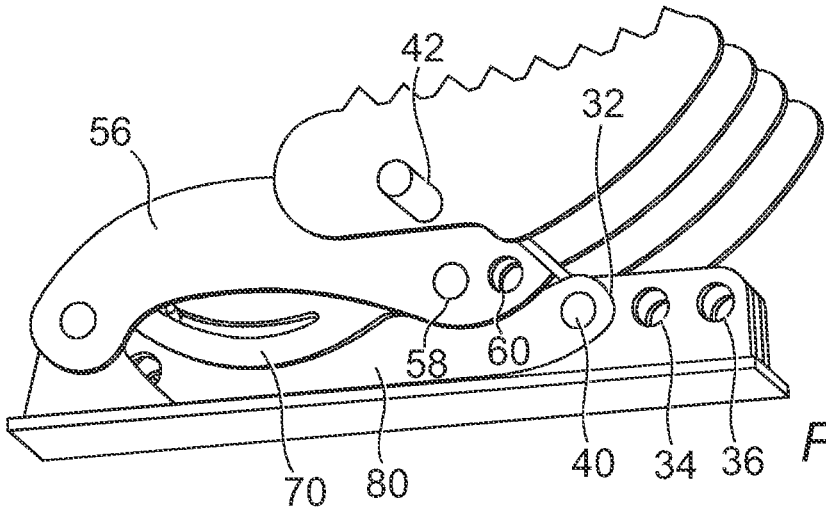
Figure 5:
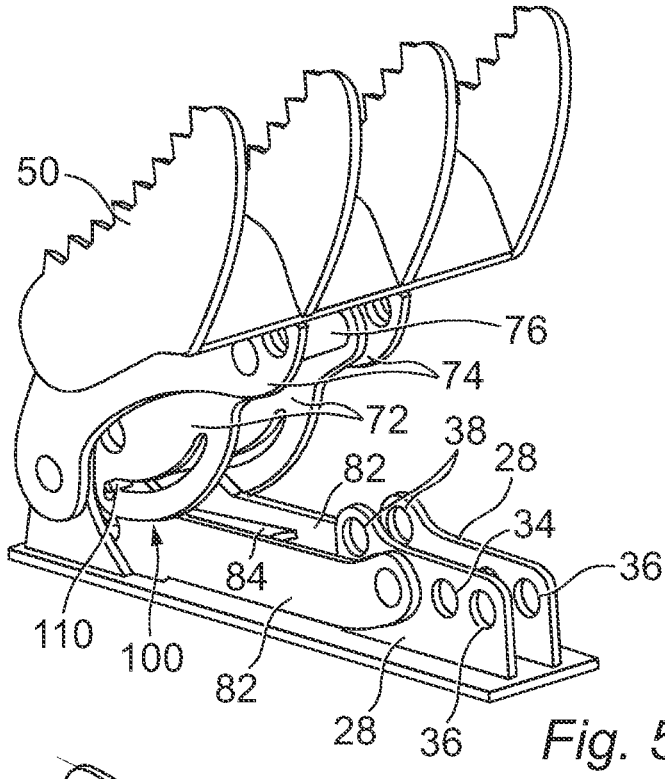

The locking pin 42 is then removed, as shown in FIG. 4. The thumb member 50 is then free to move under its own weight away from the stick 10, thereby opening the knee joint 100. As is shown in FIG. 5 the knee joint is configured such that the first pivot member 70 is free to rotate relative to the second pivot member 80 about the guide pin 110, which is engaged in the guide slot 108. As the knee joint 100 opens the guide pin 110 moves along the guide slot 108 towards the return portion 114 of the guide slot.

When the thumb member 50 reaches the position shown in FIG. 6, the guide pin 110 engages in the return portion 114 of the guide slot. Further rotation of the thumb member 50 to the position shown in FIG. 7 results in the knee joint 100 being straight and the locking pin aperture 104 at the second end 78 of the first linkage member 70 being aligned with the locking pin aperture 106 at the second end 88 of the second linkage member 80. The operator then places the removable locking pin 102 to engage with both locking pin apertures 104, 106 and lock the knee joint in its fully open position. A detent member (not shown) can optionally be provided on either the first or second linkage members 70, 80 to prevent the knee joint 100 opening any further beyond the position shown in FIG. 7 before the removable locking pin 102 is engaged. As can be seen from FIG. 8, the locking pin apertures 104, 106 and the return portion 114 of the guide path 108 are positioned such that in the working position of FIG. 8, the pivot pin 40, the removable locking pin 102 and the pivot pin 76 are arranged on the same line L, so that forces transmitted from the thumb member 50 through the linkage members 70, 80 are transmitted through the removable locking pin 102 and not through the guide pin 110.

With the thumb member 50 locked in position as shown in FIG. 8, the excavator can be operated in the manner known in the art. If an operator wishes to move the thumb member 50 to a different working position, the thumb member 50 must first be moved to the storage position, in which the thumb member may also be held may during travel of the excavator, or for use of the excavator when a thumb member is not required. To move the thumb member 50, the locking pin 102 is first removed from the locking pin apertures 104, 106, as shown in FIG. 7, so that the knee joint 100 is free to rotate about the guide pin 110. The thumb member is then moved through the position shown in FIG. 6 to the position shown in FIG. 5. Further rotation of the thumb member to the position shown in FIG. 4 results in the guide pin 110 leaving the return portion 114 of the guide slot 108 and travelling along the guide slot 108. The locking pin 42 is inserted in the locking pin apertures 38, 60 of the base member 24 and thumb member 50 to lock the thumb member in the storage position shown in FIG. 3.

Figure 9:
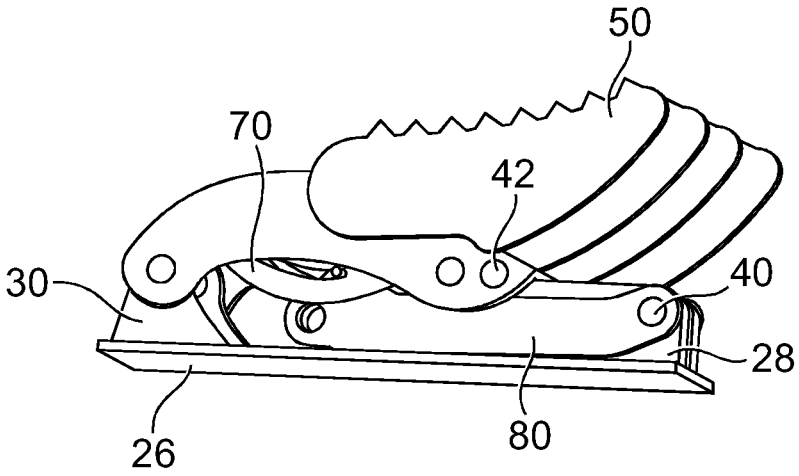
FIGS. 9 to 14 show sequentially the steps of unfolding the thumb assembly of FIG. 2 from a storage position in FIG. 9 to a second working position in FIG. 14.
Figure 10:
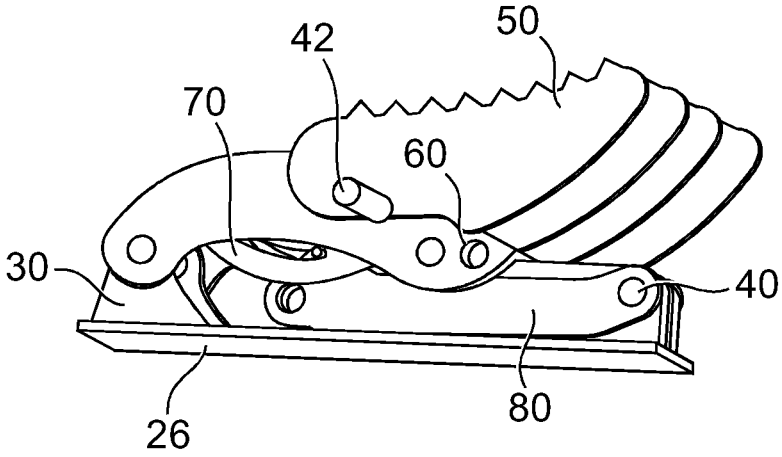
Figure 11:
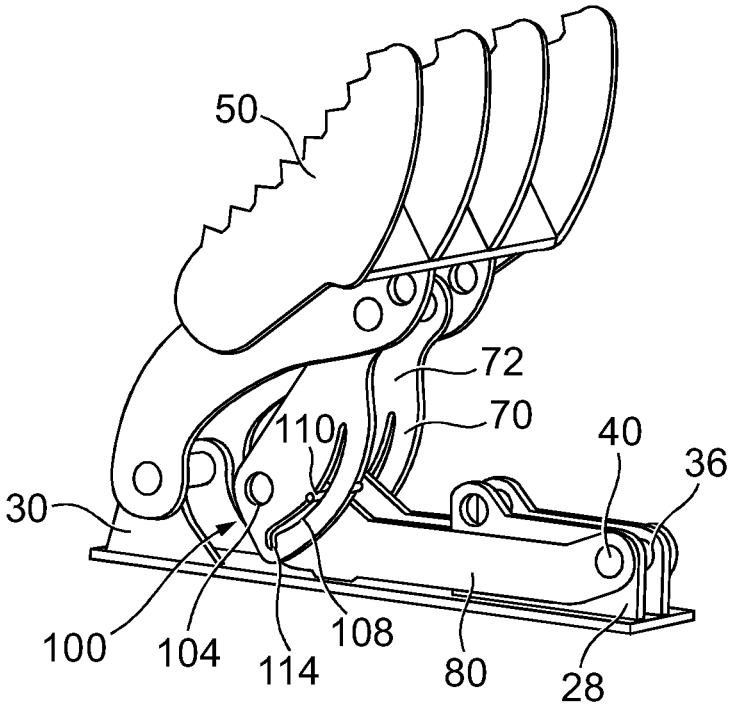

FIGS. 9 to 14 show stages in the movement of the thumb member 50 to a different working position. First the removable pivot pin 40 is removed from the lower 32 of the three pivot joint locations 32, 34, 36, as shown in FIG. 3, and the second pivot member 80, which remains attached to the first pivot member 70 at the knee joint, is pulled along the base member 24 to the position shown in FIG. 9, so that the removable pivot pin 40 at the first end of the second linkage member 80 is connected with the upper 36 of the three pivot joint locations 32, 34, 36, as shown in FIG. 9. The locking pin 42 is then removed, as shown in FIG. 10. The thumb member 50 is then free to move under its own weight away from the stick 10, thereby opening the knee joint 100. As is shown in FIG. 11 the knee joint is configured such that the first pivot member 70 is free to rotate relative to the second pivot member 80 about the guide pin 110, which is engaged in the guide slot 108. As the knee joint 100 opens the guide pin 110 moves along the guide slot 108 towards the return portion 114 of the guide slot. The guide pin 110 travels along a significantly greater length of the guide slot 108 during unfolding when the removable pivot pin 40 is connected with the upper pivot joint location 36, as shown in FIG. 11, than when it is connected to the lower pivot joint location 32, as shown in FIG. 5.

Figure 12:
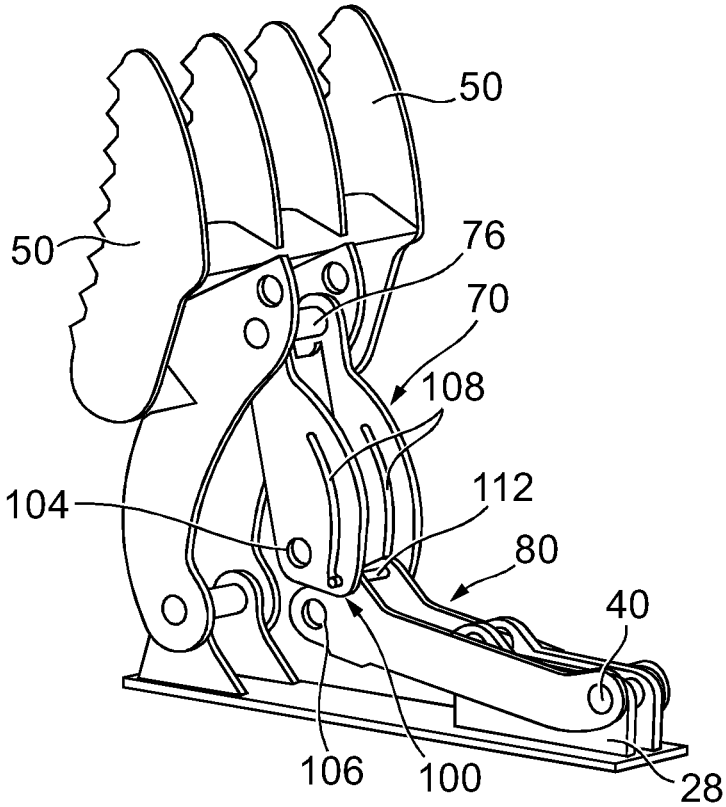
Figure 13:
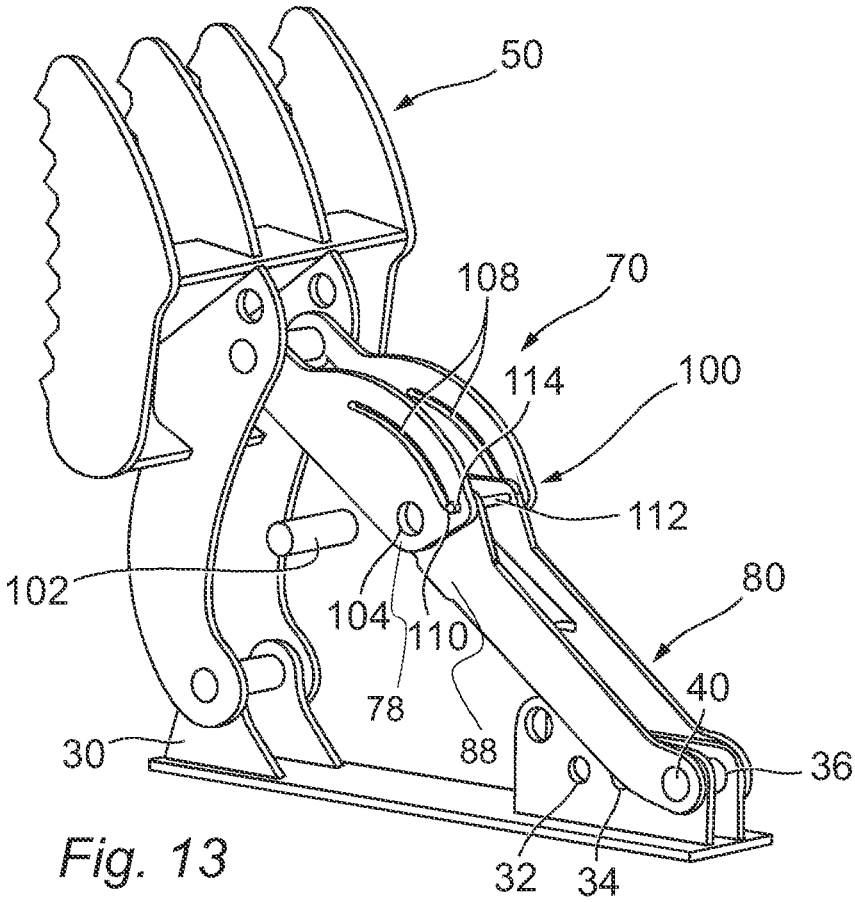
Figure 14:
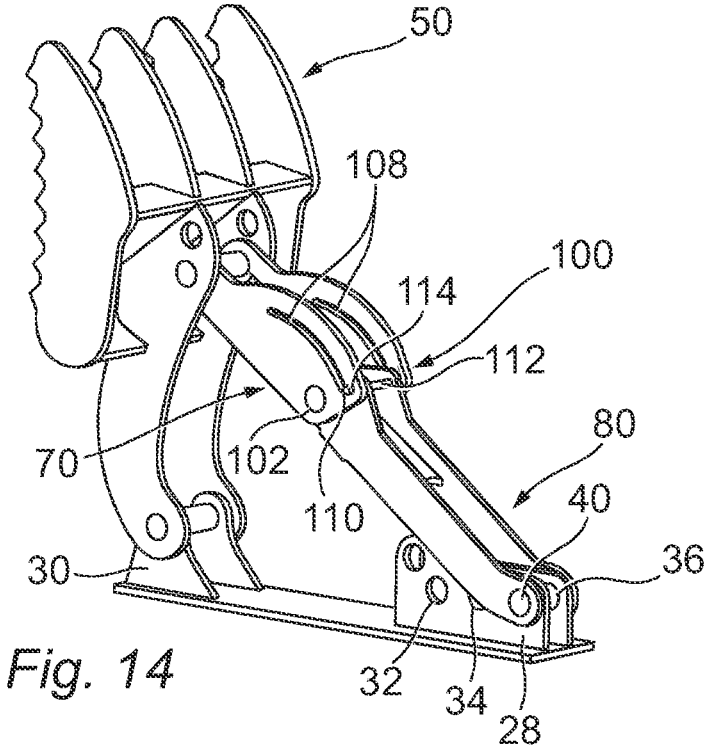

When the thumb member 50 reaches the position shown in FIG. 12, the guide pin 110 engages in the return portion 114 of the guide slot. Further rotation of the thumb member 50 to the position shown in FIG. 13 results in the knee joint 100 being straight and the locking pin aperture 104 at the second end 78 of the first linkage member 70 being aligned with the locking pin aperture 106 at the second end 88 of the second linkage member 80. The operator then places the removable locking pin 102 to engage with both locking pin apertures 104, 106 and lock the knee joint in its fully open position, as shown in FIG. 14.

Figure 15:
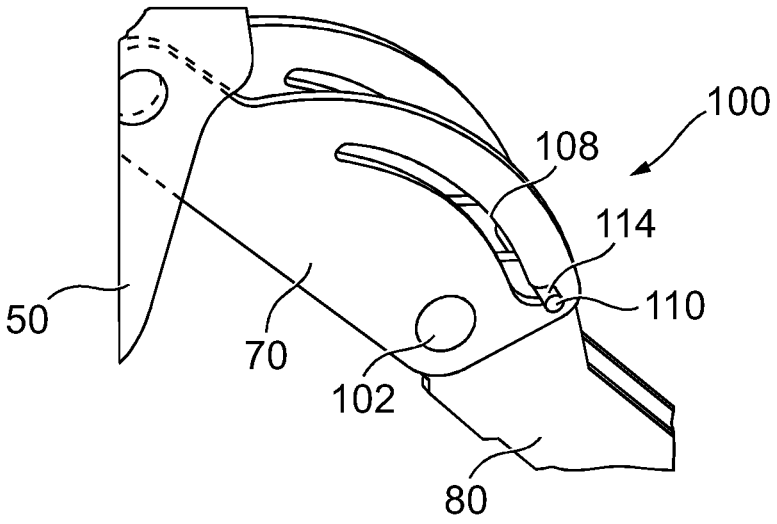
FIG. 15 shows a partial enlarged view of a knee joint of the thumb assembly of FIG. 2 in an working position.
Figure 16:
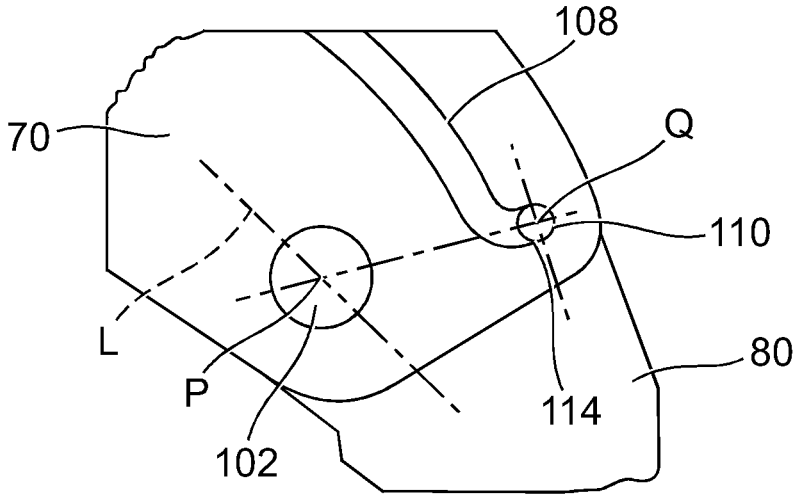
FIG. 16 shows a side elevation on the knee joint shown in FIG. 15.

As can be seen most clearly from FIGS. 15 and 16, the return portion 114 of the guide path 108 extends away from the locking pin aperture 104 provided on the first linkage member 70. In the illustrated example the return portion 114 extends along a line P-Q when in the locked working position, where P is the centre of the locking pin apertures 104, 106 and Q is the centre of the guide pin 110. The return portion 114 is dimensioned such that when the guide pin 110 is engaged at the end of the return portion 114, and the locking pin apertures 104, 106 are locked by the locking pin 102, the guide pin 110 is restrained in the return portion 114 and cannot move along the remainder of the guide path 108. In the working position the guide pin 110 sits in the return portion 114, the sides of which exert a restraining moment on the guide pin 110 to prevent buckling of the knee joint 100 between first and second linkage members 70, 80, as can be seen in FIGS. 8 and 14. The locking pin 102 is directly in line with the pivot pin location 58 on the thumb member 50 and the pivot joint location 32, 34, 36 on the base member 24, and as so, takes substantially all of any compression load on the linkage. The guide pin 110 ensures that the knee joint stays straight.

The thumb assembly of the present disclosure can be readily moved between a working position and a storage position and back, since the locking pin 102 is all that needs to be removed to allow the assembly to move from the working position to the storage position, and the locking pin 42 is all that needs to be removed to allow the assembly to move from the storage position to the working position. Although the locking pins 42, 102 have been described as separate pins, they may be the same pin, used in two different locations. The linkage members 70, 80 remain connected to the thumb member 50 and base member 24 or stick 10 respectively in both the working and storage positions.

It has been found that providing the guide path 108 as a curved path with a centre of curvature on the inside of the knee joint 100 prevents binding of the guide pin 110 in the guide slot 108 during folding and unfolding of the knee joint.

The thumb assembly of the present disclosure allows a stiff link thumb member to be folded back without the need to disconnect heavy components.

Although the illustrated embodiment includes a thumb member 50 having two web members 56, which engage with two thumb mounting lugs 30, a first linkage member 70 having two webs 72, each with a guide path 108, and a second linkage member 80 including two webs 82, which engage with two linkage member mounting plates 28, it is to be understood that the thumb member 50 may comprise more or fewer web members 56, engaging with any suitable thumb mounting means, the first linkage member 70 may have more or fewer webs 72, any of which may include a guide path 108, and the second linkage member 80 may have more or fewer webs 82, engaging with any suitable linkage member mounting means.

It will be apparent to those skilled in the art that various modifications and variations can be made to the thumb assembly and the method of moving a thumb member of a thumb assembly. Other embodiments will be apparent to those skilled in the art from consideration of the specification and practice of the disclosed thumb assembly and the method of moving a thumb member of a thumb assembly. It is intended that the specification and examples be considered as exemplary only, with a true scope being indicated by the following claims and their equivalents.

What is claimed is:

1. A thumb assembly mountable to a stick of an excavator, the thumb assembly comprising:

a base member having at least one joint location, a thumb member pivotally connected to the base member, a first linkage member including first and second ends and being pivotally connected at the first end to the thumb member, the second end of the first linkage member including a first locking aperture, a removable locking member configured to be selectively disposed inside the first and second locking apertures, a second linkage member including first and second ends and being pivotally connectable at the first end to the joint location, the second end of the second linkage member including a second locking aperture, a removable locking member configured to be selectively disposed inside the first and second locking apertures, wherein the first and second linkage members are connected by a knee joint at their second ends such that they are foldable relative to each other between a working position in which the thumb member extends away from the base member and a storage position in which the thumb member extends close to the base member, wherein the knee joint is configured to permit, when the locking member is removed from the first and second locking apertures, both relative rotation and relative sliding of the first and second linkage members.

2. A thumb assembly according to claim 1, wherein the knee joint includes a guide path on one of the first and second linkage members and a guide engaging tool on the other of the first and second linkage members adapted to engage in the guide path to permit relative sliding of the first and second linkage members through sliding of the guide engaging tool along the guide path.

3. A thumb assembly according to claim 2, wherein the guide path includes a return portion at an end thereof for engaging the guide engaging tool when the first and second linkage members are in the working position.

4. A thumb assembly according to claim 2, wherein the guide path is a slot and the guide engaging tool is a guide pin.

5. A thumb assembly according to claim 2, wherein the guide path is provided on the first linkage member and the guide engaging tool is provided on the second linkage member.

6. A thumb assembly according to claim 1, further including a removable pivot pin, wherein the base member has a plurality of joint locations, and the second linkage member is selectively pivotally connectable to each of the plurality of joint locations by the removable pivot pin.

7. A thumb assembly according to claim 1, wherein the locking member is adapted to lock the first and second linkage members against relative rotation in the working position.

8. A thumb assembly according to claim 1, further including a second locking member adapted to lock the thumb member to the base member in the storage position.

9. An excavator comprising a stick, a bucket mounted on the stick and a thumb assembly according to claim 1, wherein the base member is mounted on the stick and the thumb member is pivotally connected to the base member in opposed relationship to the bucket.

10. A method of moving a thumb member of a thumb assembly mounted to a stick of an excavator, the thumb assembly comprising a base member having first and second joint locations, a first linkage member including first and second ends and being pivotally connected at the first end to the thumb member, the second end of the first linkage member including a first locking aperture, a second linkage member including first and second ends and being selectively pivotally connectable at the first end to the first and second joint locations, the second end of the second linkage member including a second locking aperture, and a removable locking member configured to be selectively disposed inside the first and second locking apertures, wherein the thumb member is pivotally connected to the base member and wherein the first and second linkage members are connected by a knee joint at their second ends, the method comprising the steps of:

connecting the first end of the second linkage member to the first joint location while the thumb member is locked to the base member in the storage position;

unlocking the thumb member from the base member;

when the locking member is removed from the first and second locking apertures, moving the thumb member to a first working position while permitting both relative rotation and relative sliding of the first and second linkage members; and locking the first and second linkage members against relative rotation in the first working position.

11. The method of claim 10 including the further steps of:

unlocking the first and second linkage members to permit relative rotation;

moving the thumb member to the storage position while permitting both relative rotation and relative sliding of the first and second linkage members;

locking the thumb member to the base member;

disconnecting the first end of the second linkage member from the first joint location;

connecting the first end of the second linkage member to the second joint location;

unlocking the thumb member from the base member;

moving the thumb member to a second working position while permitting both relative rotation and relative sliding of the first and second linkage members; and locking the first and second linkage members against relative rotation in the second working position.

* * * * *

UNITED STATES PATENT AND TRADEMARK OFFICE

CERTIFICATE OF CORRECTION

PATENT NO. : 8,827,626 B2
APPLICATION NO. : 13/298648
DATED : September 9, 2014
INVENTOR(S) : Gregory A. Seljestad It is certified that error appears in the above-identified patent and that said Letters Patent is hereby corrected as shown below:

In the Claims

Column 7, lines 2-4, in Claim 1, delete "including a first locking aperture, a removable locking member configured to be selectively disposed inside the first and second locking apertures," and insert -- including a first locking aperture, --.

Signed and Sealed this
Fifteenth Day of September, 2015

Michelle K. Lee

Michelle K. Lee
*Director of the United States Patent and Trademark Office*